US007201564B2

(12) United States Patent
Bolms et al.

(10) Patent No.: US 7,201,564 B2
(45) Date of Patent: Apr. 10, 2007

(54) TURBINE VANE SYSTEM

(75) Inventors: Hans-Thomas Bolms, Muelheim A.D. Ruhr (DE); Michael Strassberger, München (DE); Peter Tiemann, Witten (DE)

(73) Assignee: Siemens Aktiengesellschaft, Munich (DE)

( * ) Notice: Subject to any disclaimer, the term of this patent is extended or adjusted under 35 U.S.C. 154(b) by 752 days.

(21) Appl. No.: 10/344,730

(22) PCT Filed: Aug. 3, 2001

(86) PCT No.: PCT/EP01/09015

§ 371 (c)(1),
(2), (4) Date: Feb. 14, 2003

(87) PCT Pub. No.: WO02/14654

PCT Pub. Date: Feb. 21, 2002

(65) Prior Publication Data

US 2003/0180147 A1 Sep. 25, 2003

(30) Foreign Application Priority Data

Aug. 16, 2000 (EP) ..... 00117667

(51) Int. Cl.
*F01D 5/08* (2006.01)
*F01D 5/18* (2006.01)
*F01D 5/20* (2006.01)

(52) U.S. Cl. ..... 416/97 R; 416/96 A; 415/115

(58) Field of Classification Search ..... 416/97 R, 416/96 R, 96 A; 415/115, 116, 191
See application file for complete search history.

(56) References Cited

U.S. PATENT DOCUMENTS

| | | | | | |
|---|---|---|---|---|---|
| 3,045,965 | A | * | 7/1962 | Bowmer | 416/97 R |
| 3,094,310 | A | | 6/1963 | Bowmer | |
| 3,540,810 | A | * | 11/1970 | Kercher | 416/97 R |
| 3,858,290 | A | * | 1/1975 | Albani | 416/96 A |
| 4,218,179 | A | | 8/1980 | Barry | |
| 4,818,178 | A | | 4/1989 | Sibbertsen | |
| 5,813,827 | A | | 9/1998 | Nordlund | |

FOREIGN PATENT DOCUMENTS

| | | | | |
|---|---|---|---|---|
| DE | 12 10 254 | | 3/1963 | |
| GB | 976124 | A * | 11/1964 | 416/97 R |
| JP | 62135603 | A * | 6/1987 | |

* cited by examiner

*Primary Examiner*—Theresa Trieu
(74) *Attorney, Agent, or Firm*—Harness, Dickey & Pierce, P.L.C.

(57) ABSTRACT

A turbine vane, especially a turbine vane of the last stages, respectively includes a lower area which is radially and externally arranged, an upper area which is radially and internally arranged, and a radial cooling air channel extending between the upper area and the lower area. Cooling air can be introduced into the channel via an inlet in the lower area, and can be at least partially discharged via an outlet in the upper area. The cooling channel includes a radial inner channel through which the cooling air flows from the lower area to the upper area, and an outer channel which is adjacent to the inner channel on the circumferential side thereof. The outer channel communicates with the inner channel and includes an outlet which is arranged in the lower area. Part of the cooling air flows back in the direction of the lower area via the outer channel and emerges via the outlet.

20 Claims, 3 Drawing Sheets

TURBINE VANE SYSTEM

This application is the national phase under 35 U.S.C. § 371 of PCT International Application No. PCT/EP01/09015 which has an International filing date of Aug. 3, 2001, which designated the United States of America and which claims priority on European Patent Application number EP 00117667.6 filed Aug. 16, 2000, the entire contents of which are hereby incorporated herein by reference.

FIELD OF THE INVENTION

The invention generally relates to an arrangement of turbine guide vanes. In particular, it relates an arrangement including turbine guide vanes of the rearmost stages, in each case with a foot region arranged radially on the outside, with a head region arranged radially on the inside and with a radial cooling-air duct which runs between the head region and the foot region and into which cooling air can be introduced into an inlet orifice in the foot region and can be at least partially discharged through an outlet orifice in the head region.

BACKGROUND OF THE INVENTION

A hot gas stream driving a turbine is conducted from the stationary turbine guide vanes to the turbine moving blades which are fastened on disks rotating about a central turbine axis. A circular arrangement of turbine guide vanes, which are fastened with their radially outer foot regions on a stationary turbine casing wall, in this case alternates with an arrangement of turbine moving blades on a rotating disk. The radially inner head regions of the turbine guide vanes are contiguous to a U-shaped inner ring which on its outside has a labyrinth seal which seals off against a flow of hot gas around the U-ring.

Cooling air is used, as a rule, for cooling the turbine blades heated by the hot gas flowing past. Where turbine guide vanes are concerned, the cooling air flows, for example through a radial cooling-air duct, formed in the turbine guide vane, from the radially outer foot region of the turbine guide vane as far as the radially inner head region. The cooling air is introduced from the head region into the contiguous U-shaped ring. The latter is cooled by the cooling air flowing past. Moreover, an excess pressure of the cooling air is intended to prevent hot gas from penetrating into the cavity formed by the head region of the turbine guide vanes and by the U-shaped ring lying below them.

One problem, in this case, is that, for manufacturing and cost reasons, the U-shaped ring usually consists of a material of relatively low temperature resistance. When flowing through the turbine guide vane, the cooling air, as a rule, heats up to the maximum permissible temperature of the turbine guide vane. Thus, when it flows into the U-ring, the cooling air which is already at a very high temperature may not provide sufficient cooling of the U-ring in the case of small cooling-air quantities which would suffice for cooling the turbine guide vane of a rear stage which is not very hot, as compared with the other turbine guide vane stages. This presents a problem also because the cooling air introduced into the cavity formed by the U-ring and the turbine vane head region, after flowing through the cavity, is discharged and flows in the direction of the rearmost, largely uncooled heat-sensitive turbine moving blade disk.

The solution adopted hitherto for solving the problem has been to conduct a large amount of cooling air through a central bore of the turbine guide vane or through a cooling-air duct of a largely hollow-cast turbine guide vane.

SUMMARY OF THE INVENTION

An object of an embodiment of the present invention is, therefore, to provide an arrangement of turbine guide vanes, which has a lower cooling-air requirement, at the same the U-shaped ring being sufficiently cooled.

An object may be achieved in that the cooling-air duct has a radial inner duct, through which the cooling air flows from the foot region to the head region, and an outer duct which is contiguous to the inner duct and which at least partially surrounds the inner duct circumferentially, communicates with the inner duct and has an outlet orifice in the foot region, a cooling-air fraction flowing through the outer duct back in the direction of the foot region and flowing out through the outlet orifice.

What is achieved by dividing the cooling-air duct into an inner duct and an outer duct is that the cooling air first flows through the inner duct and partially flows out at the foot region in order to cool the U-shaped ring and partially, after being diverted, flows back through the outlet duct again. The inner duct has the total cooling-air quantity flowing through it and has a smaller cooling-air quantity flowing around it in the form of a counterflow. The cooling-air stream in the outer duct surrounding the inner duct is in this case very rapid. It therefore provides good cooling of the surrounding regions of the turbine guide vane by virtue of the increased cooling capacity of a rapid cooling-air flow. The cooling air flowing back in a rapid stream, on the one hand, isolates the inner duct and makes it possible for the cooling air to have a low temperature at the outflow point into the U-ring at the head region, without large quantities of cooling air having to be used.

At the same time, the cooling air flowing back cools the side walls of the cooling-air duct and consequently the surrounding regions of the turbine guide vane which are the load-bearing regions of the turbine guide vane. According to an embodiment of the invention, the walls of the turbine vane which surround the cooling-air duct are made thicker than in the prior art and are therefore more stable. Thus, by part of the cooling-air stream being diverted through the outer duct and by the more rapid conduction of the cooling air in the outer duct, the total cooling-air quantity is reduced and, at the same time, the temperature of the cooling air emerging from the turbine guide vane in the head region in order to cool the U-ring is lowered.

An embodiment of the invention thus affords the advantage that both the turbine guide vane and the U-shaped ring are sufficiently cooled by small cooling-air quantities.

If the turbine guide vanes are turbine guide vanes of the rearmost stages, there is a relatively high saving in terms of cooling air, as compared with the use of conventional cooling-air ducts, because the hot gas, by the time it reaches the last stages, has already been appreciably cooled. Therefore the turbine guide vanes of the rearmost stages, in principle, are not heated up to such a great extent. Precisely for these turbine guide vanes, therefore, the arrangement according to the invention of the turbine guide vanes affords the possibility of a substantial saving in terms of cooling air.

If the outer duct surrounds the inner duct circumferentially virtually on all sides, the heat radiation of the cooling air conducted through the inner duct is discharged, virtually on all sides, by the part of the cooling air which can be conducted through the outer duct. A high heat transmission is possible in a short time on account of the large radiant surface. The cooling air arriving in the head region thus has a very low temperature and can optimally cool the U-shaped ring.

If the inner duct has at least one communication bore, through which the cooling air can flow over into the outer duct, the cooling air is accelerated to a very great extent at the location of the bore. This improves the cooling properties of the cooling air in the outer duct, since more heat can be absorbed due to the higher velocity.

A long cooling-air path within the turbine guide vane and therefore a good utilization of the cooling air are achieved if the inner duct has at least one communication bore at a head-side end region. The cooling air can shield the cooling-air pipe, over virtually the entire length between the head and the foot region, from the hot vane wall, so that the cooling air emerging in the head region of the turbine guide vane has, even in the case of a small cooling-air stream in the inner duct, a sufficiently low temperature to cool the U-shaped ring effectively. The cooling-air stream flowing back in the outer duct at the same time cools the surrounding regions of the turbine guide vane.

It is advantageous if the turbine guide vane has at the foot region, in a trailing edge region, an outlet orifice which is connected to the outer duct. Diverted cooling air which has brushed past the inner duct emerges from the turbine guide vane through the outlet orifice, without any intermixing with the introduced cooling air occurring. The arrangement of the outlet orifice in the trailing edge region prevents a penetration of onflowing hot gas which would lead to damage. Since the outlet orifices with the cooling air flowing through the outer duct are accommodated in the foot region of the turbine guide vane, the cooling air has a very long path within the turbine guide vane and, even in the case of relatively small cooling-air quantities, can absorb a correspondingly large amount of heat energy from the turbine guide vane and discharge it outward, without the air in the inner duct being heated up.

If the inner duct is cylindrical, the velocity and nature of the flow of the cooling air flowing around along the entire duct length. Therefore also the transporting away of heat, are approximately the same. A uniform cooling capacity is thereby ensured.

An advantageous embodiment of the invention is provided if the inner duct is a cooling-air guide pipe which can be inserted into the cooling-air duct and which is arranged at a distance from inner walls of the cooling-air duct, and if the outer duct is formed by the interspace between the cooling-air guide pipe and the inner walls of the cooling-air duct. The production of the cooling duct is simplified. The cooling-air guide pipe can be inserted into the cooling-air duct after casting. The outer duct then consists of the interspace extending around the cooling-air guide pipe. The thickness of the interspace, which corresponds to the distance of the cooling-air guide pipe from the side walls of the cooling-air duct, can be set, as required. The narrower the interspace is, the higher the velocity of the forced-through cooling air becomes.

An increase in cooling-air velocity in turn increases the ability of the latter to transport away heat.

It is advantageous if the cross section of the outer duct is selected such that the cooling air flows rapidly through the duct and consequently sufficient cooling is ensured.

An object also relates to a method for producing a turbine guide vane.

An object may be achieved by a casting method for producing an arrangement of turbine guide vanes. The method employing a core which generates the cooling-air duct of the turbine guide vane, the core having a smaller cross section than conventional cores for the casting of turbine guide vanes. A cooling-air guide pipe is provided with at least one communication bore being inserted, after casting, into the cooling air duct at a distance from the inner walls of the cooling air duct. Further, outlet orifices which pass through as far as the outer contour of the turbine guide vane are introduced into the wall in the trailing edge region of the foot region of the turbine guide vane.

During production, the form of the vane core for casting can be reduced in size, as compared with conventional casting cores. Since the resulting cooling duct is therefore smaller, the wall thickness of the turbine vane thus increases sharply, in particular, toward the inlet edge. Casting is therefore appreciably simplified in terms of uncritical wall thicknesses. After casting, a cooling-air guide pipe is then inserted. Between the cooling air guide pipe and the cooling-duct inner wall there is only a narrow outer duct which surrounds the cooling-air guide pipe annularly. By the reduction in size of the casting core and therefore of the area of the cooling-duct inner wall, the radiant surface for heat radiation and consequently the heat quantity discharged per unit time into the cooling-air stream are reduced. The cooling air is therefore not heated up to such a great extent. A smaller cooling-air quantity is sufficient.

The cooling of the turbine guide vane is sufficient at the relatively low temperatures, particularly in the rear stages.

BRIEF DESCRIPTION OF THE DRAWINGS

An exemplary embodiment of the invention will be given with reference to the figures of which.

DETAILED DESCRIPTION OF THE PREFERRED EMBODIMENTS

Figure 1:
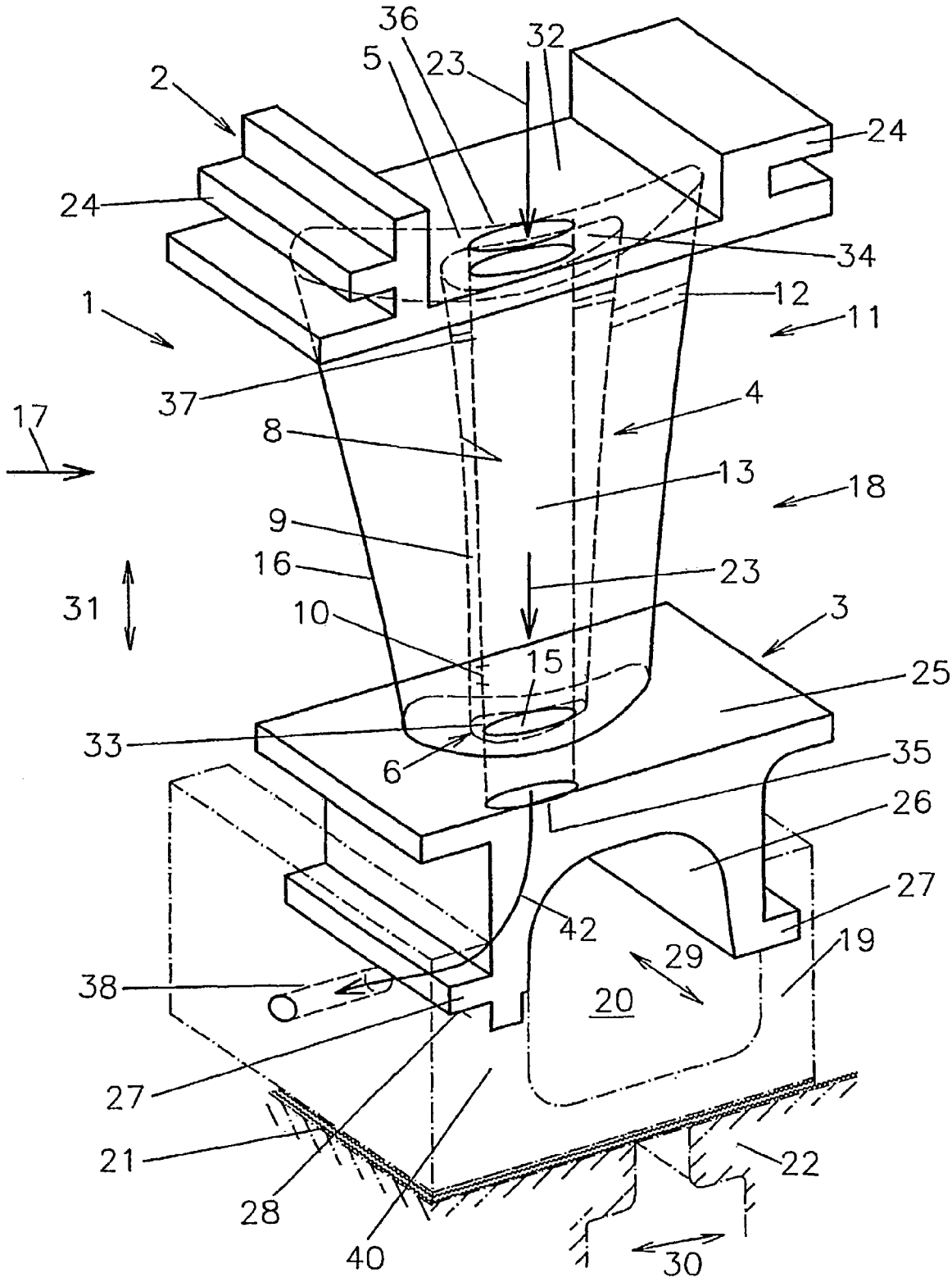
FIG. 1 shows a turbine guide vane of the rearmost stages.

FIG. 1 shows a perspective illustration of a turbine guide vane 1 of the rearmost stages. With the aid of the foot region 2, which has holding projections 24, the turbine guide vane 1 is fastened to an inner wall, not illustrated, of a cylindrical turbine casing. The turbine guide vane 1 extends from there with its vane leaf 18 radially in the direction of a central turbine axis 30 of the turbine casing. The radially inner termination of the turbine guide vane 1 is formed by the head region 3 which has a platform 25 and, with respect to the turbine axis 30, a radially inner arcuate recess 26. A U-shaped ring 19 is coupled to this head region 3 by means of rail-like holding projections 27. The holding projections 27 in this case engage in holding grooves 28 of the U-shaped ring 19.

The arcuate recess 26 of the head region 3 delimits, together with the U-shaped ring 19, a cavity 20, the longitudinal direction 29 of which runs transversely to the turbine axis 30 and to a vane axis 31. Located on the U-shaped ring 19 radially on the inside is a labyrinth seal 21. The latter seals off against a direct throughflow of hot gas 17 the turbine moving blade disk 22 which, during the operation of the turbine, rotates about the central turbine axis 31 and lies contiguously below said labyrinth seal and which is equipped with turbine moving blades, not illustrated.

The vane leaf 18 has a radial cylindrical cooling-air duct 4 which runs continuously from an inlet orifice 36 of the cooling air 23 in the foot region 2 of the turbine guide vane 1 as far as its outlet orifice 35 of the cooling air in the head region 3 of the turbine guide vane 1. The cooling-air duct has a cross-sectional contour 34 which, in the region of the vane leaf 18 and of the foot region 2, resembles the outer contour 16 of the vane leaf 18. When viewed from the foot region 2, the cross-sectional contour 34 of the cooling-air duct 4 is essentially maintained in its form to just before the head region 3, but may decrease in size. At the entry of the cooling-air duct 4 into the head region 3, the cross section 34 narrows in the form of a continuous step 33. This narrowed cross section 34 is then approximately maintained as far as the recess 26 in the head region 3, in which recess lies the outlet orifice 35 of the cooling duct 4 into the cavity 20.

A cylindrical cooling-air guide pipe 13 is inserted approximately centrally into the cooling-air duct 4. The cooling-air guide pipe 13 has a virtually uniformly elliptic cross section 15. The cooling-air guide pipe 13 is held at the head region 3 of the turbine guide vane 1 essentially in that it reaches as far as the continuous step 33 with a cross section 15 adapted to the transition or is even inserted in the head region 3 into the narrowed cross section 34 of the cooling-air duct 4. The cooling-air guide pipe 13 is held centrally in the foot region 2, for example, by means of spacer webs 37 mounted on side walls 8 of the cooling-air duct 4. The cooling-air duct 4 can be directly cast, during the casting of the turbine vane 1, by the insertion of a casting core. The cooling-air guide pipe 13 is inserted, after casting, into the cooling-air duct 4.

In the foot region 2, the cooling air 23 is introduced into the inlet orifice 36 of the cooling-air guide pipe 13 which reaches as far as a top side 32 of the foot region 2 of the turbine guide vane 1.

Figure 2:
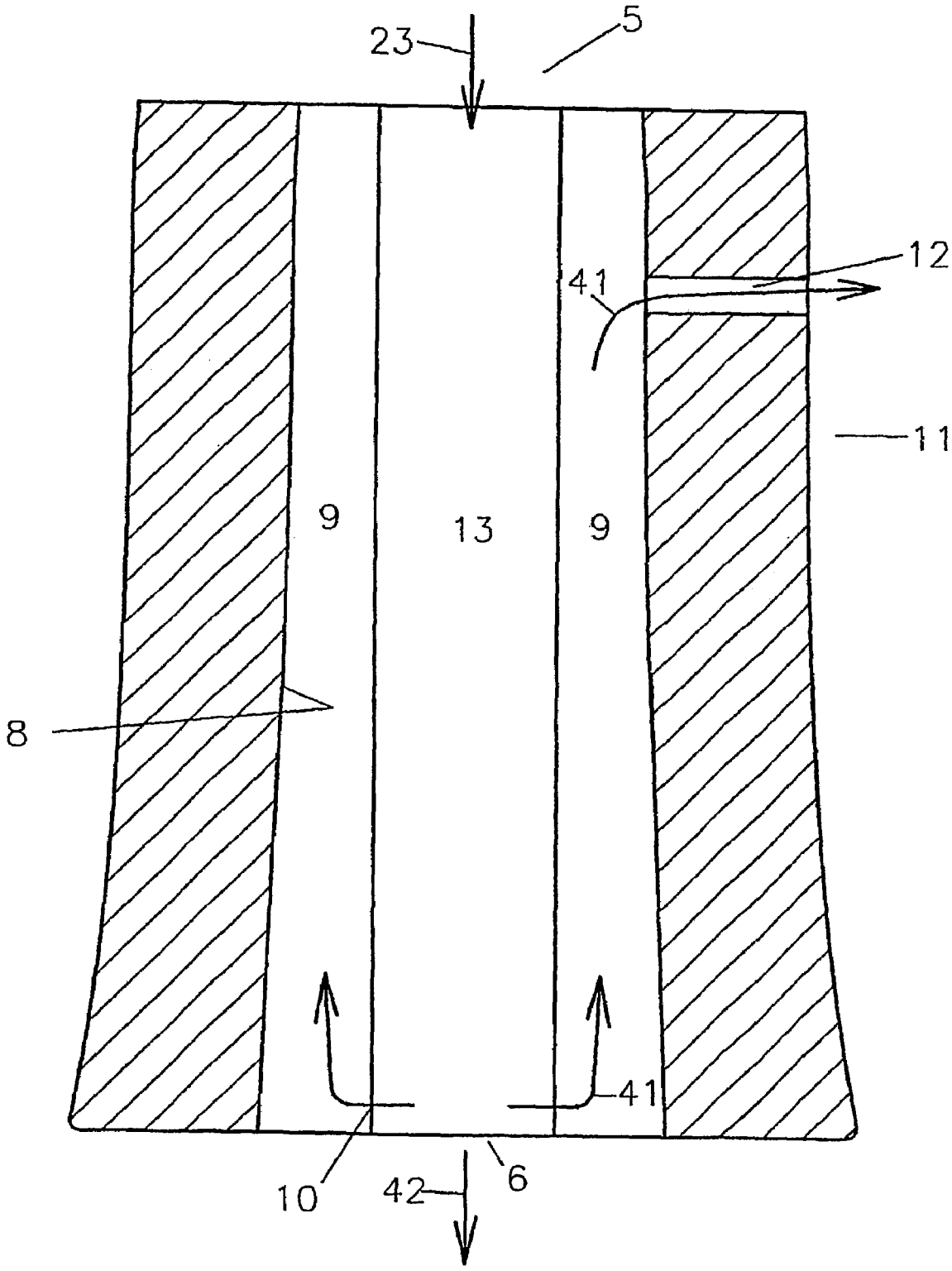
FIG. 2 shows a longitudinal section through a turbine guide vane according to FIG. 1.

The cooling air 23 then flows through the cooling-air guide pipe 13 as far as a communication bore 10. One cooling-air stream fraction 42 flows further on as far as the head region 3 of the turbine vane 1 and there through the outlet orifice 35 into the cavity 20. Another cooling-air stream fraction 41 flows from the cooling-air guide pipe 13 through a communication bore 10 into an outlet duct 9 between the cooling-air guide pipe 13 and the cooling-air duct 4 and there, in the opposite direction, toward the foot region 2, as illustrated in FIG. 2. By use of the narrowed bores 10, the cooling-air fraction 41 flows, accelerated, onto the cooling-duct inner wall 8. This gives rise, due to the smaller diameter of the bore 10, to an acceleration of the cooling-air flow 41 and therefore to a very pronounced cooling effect on the cooling-duct inner wall 8. Since the outer duct 9 is narrower than the cooling-air guide pipe 13, the cooling-air stream fraction 41 flows more rapidly there.

Finally, the heated cooling air 41 is discharged through an outlet orifice 12 which, at the trailing edge region 11 of the vane leaf 18, extends from the outer duct 9 to the vane outer contour 16 of the turbine guide vane 1. The cooling-air fraction 42 flowing out through the outlet orifice 35 in the head region 3 first flows into the cavity 20 and cools the U-shaped ring 19 which delimits the cavity 20 radially on the inside. The cooling-air stream 42 can then emerge through a bore 38 in a wall 40 of the U-shaped ring 19.

FIG. 2 shows a longitudinal section through the turbine guide vane 1 according to FIG. 1. The entire cooling-air stream 23, which flows into the cooling-air guide pipe 13 at the foot-side end region 5, is split into two cooling-air stream fractions. These include the deflected cooling-air stream 41, which flows through the bores 10 at the head-side end region 6 into the outer duct 9 and flows out again at the outlet orifice 12, and the cooling-air stream 42 flowing out to the U-shaped ring 19.

Figure 3:
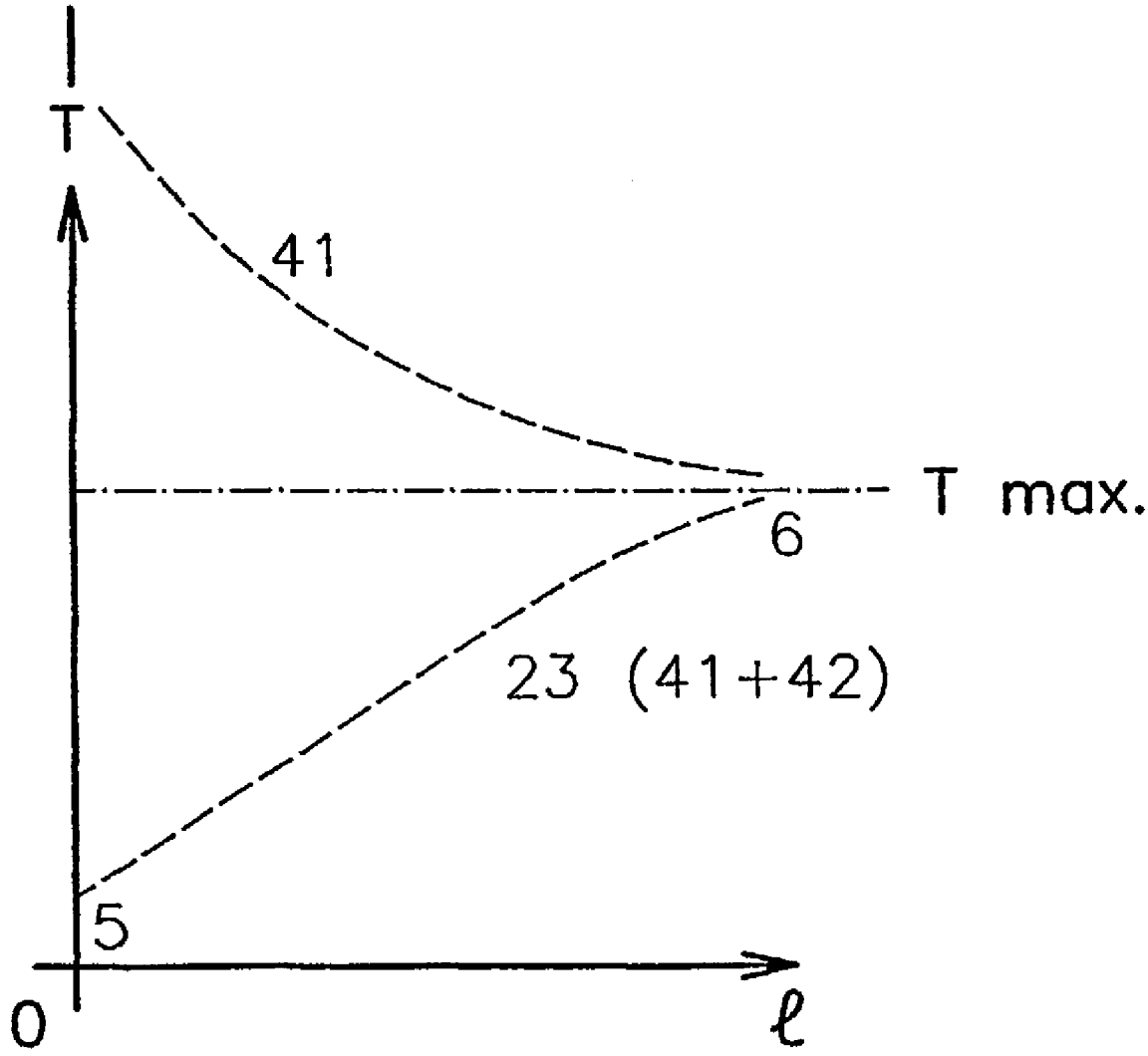
FIG. 3 shows a diagrammatic illustration of the temperature development of the cooling-air mass flows.

FIG. 3 shows the development of the temperature T of the cooling-air stream fractions 41, 42 while they flow through the turbine guide vane 1 in the longitudinal direction 31 as far as an end length 1 of the cooling-air duct 4. The maximum temperature Tmax is not reached by the continuous stream 42, with the result that the U-shaped ring can be sufficiently cooled. By contrast, the other cooling-air fraction 41 absorbs the greater part of the heat and conveys it out of the turbine vane, without the heat being capable of damaging the temperature-sensitive regions. The total cooling-air quantity 23, the sum of the two stream fractions 41, 42, is substantially lower than in the prior art.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A turbine guide vane, comprising:

a foot region, arranged radially on the outside;

a head region arranged radially on the inside; and a cooling-air duct, running between the head region and the foot region, including, an inlet orifice in the foot region adapted to receive cooling air, an outlet orifice in the head region adapted to at least partially discharge air, a radial inner duct, through which the cooling air is adapted to flow from the foot region to the head region, and an outer duct, contiguous to the inner duct and at least partially surrounding the inner duct circumferentially, adapted to communicate with the inner duct and including an outlet orifice in the foot region, wherein a cooling-air fraction is adapted to flow through the outer duct back in the direction of the foot region and is adapted to flow out through the outlet orifice.

2. The turbine guide vane as claimed in claim 1, wherein the outer duct virtually completely surrounds the inner duct circumferentially.

3. The turbine guide vane as claimed in claim 2, wherein the inner duct includes at least one communication bore, through which the cooling-air fraction is adapted to flow over into the outer duct.

4. The turbine guide vane as claimed in claim 2, wherein the communication bore is arranged in head-side end region.

5. The turbine guide vane as claimed in claim 2, wherein the turbine guide vane includes in the foot region, in a trailing edge region, an outlet orifice adapted to communicate with the outer duct.

6. The turbine guide vane as claimed in claim 2, wherein the inner duct is cylindrical.

7. The turbine guide vane as claimed in claim 2, wherein the inner duct is a cooling-air guide pipe, adapted to be inserted into the cooling-air duct and arranged at a distance from the inner wall of the cooling-air duct, and wherein the outer duct is formed by the interspace between the cooling-air guide pipe and the inner wall of the cooling-air duct.

8. The turbine guide vane as claimed in claim 7, wherein the distance is smaller than a cross section of the cooling-air guide pipe.

9. The turbine guide vane as claimed in claim 2, wherein the flow of the cooling-air fraction is relatively more rapid in the outer duct than in the inner duct.

10. The turbine guide vane as claimed in claim 1, wherein the inner duct includes at least one communication bore, through which the cooling-air fraction is adapted to flow over into the outer duct.

11. The turbine guide vane as claimed in claim 10, wherein the communication bore is arranged in head-side end region.

12. The turbine guide vane as claimed in claim 1, wherein the turbine guide vane includes in the foot region, in a trailing edge region, an outlet orifice adapted to communicate with the outer duct.

13. The turbine guide vane as claimed in claim 1, wherein the inner duct is cylindrical.

14. The turbine guide vane as claimed in claim 1, wherein the inner duct is a cooling-air guide pipe, adapted to be inserted into the cooling-air duct and arranged at a distance from the inner wall of the cooling-air duct, and wherein the outer duct is formed by the interspace between the cooling-air guide pipe and the inner wall of the cooling-air duct.

15. The turbine guide vane as claimed in claim 14, wherein the distance is smaller than a cross section of the cooling-air guide pipe.

16. The turbine guide vane as claimed in claim 1, wherein the flow of the cooling-air fraction is relatively more rapid in the outer duct than in the inner duct.

17. The turbine guide vane as claimed in claim 1, wherein the turbine guide vane is of the rearmost stages.

18. A method for producing a turbine guide vane as claimed in claim 1.

19. A casting method for producing a turbine guide vane, comprising:

generating a cooling-air duct of the turbine guide vane using a core;

inserting a cooling-air guide pipe provided with at least one communication bore, after casting, into the cooling-air duct at a distance from inner walls of the cooling-air duct; and introducing outlet orifices, extending toward an outer contour of the turbine guide vane, into the inner walls in a trailing edge region of a foot region for the turbine guide vane.

20. A casting method for producing a turbine guide vane, comprising:

generating a cooling-air duct of the turbine guide vane using a core;

inserting a cooling-air guide pipe provided with at least one communication bore, after casting, into the cooling-air duct at a distance from inner walls of the cooling-air duct; and introducing outlet orifices, extending as far as an outer contour of the turbine guide vane, into the inner walls in a trailing edge region of a foot region for the turbine guide vane; wherein the turbine guide vane further comprises, a foot region, arranged radially on the outside, a head region arranged radially on the inside, and a cooling-air duct, running between the head region and the foot region, including an inlet orifice in the foot region adapted to receive cooling air, an outlet orifice in the head region adapted to at least partially discharge air, a radial inner duct, through which the cooling air is adapted to flow from the foot region to the head region, and an outer duct, contiguous to the inner duct and at least partially surrounding the inner duct circumferentially, adapted to communicate with the inner duct and including an outlet orifice in the foot region, wherein a cooling-air fraction is adapted to flow through the outer duct back in the direction of the foot region and is adapted to flow out through the outlet orifice.

* * * * *